United States Patent [19]

Duval

[11] Patent Number: 5,069,386

[45] Date of Patent: Dec. 3, 1991

[54] CLIP FOR FASTENING A RAIL OF A RAILWAY COMPRISING DISPLACEMENT STOPPING MEANS AND SPRING CLIP

[75] Inventor: Philippe Duval, Lambres-les-Douai, France

[73] Assignee: Allevard Industries, Meylan, France

[21] Appl. No.: 474,724

[22] PCT Filed: Oct. 6, 1988

[86] PCT No.: PCT/FR88/00495

§ 371 Date: Apr. 6, 1990

§ 102(e) Date: Apr. 6, 1990

[87] PCT Pub. No.: WO89/03452

PCT Pub. Date: Apr. 20, 1989

[30] Foreign Application Priority Data

Oct. 7, 1987 [FR] France ..... 87 13860

[51] Int. Cl.[5] ..... E01B 9/40

[52] U.S. Cl. ..... 238/349; 238/338

[58] Field of Search ..... 238/310, 315, 338, 349, 238/351, 343

[56] References Cited

U.S. PATENT DOCUMENTS 3,297,253 1/1967 Astley et al. ..... 238/349
4,190,200 2/1980 Morrow ..... 238/349
4,413,777 11/1983 Brown ..... 239/349

FOREIGN PATENT DOCUMENTS 2256287 12/1974 France .
2330803 11/1976 France .

*Primary Examiner*—Robert J. Spar
*Assistant Examiner*—J. Eller
*Attorney, Agent, or Firm*—Lawrence M. Nawrocki

[57] ABSTRACT

This invention relates to a clip for fastening a rail of a railway on a rail support comprising: a spring clip forming a device for fastening or clamping the rail on a rail support, constituted by a clip made of elastic metal having a first end and a second end and presenting successively, from the first end, a first section forming a substantially rectilinear arm, a second section forming a substantially 180° bend, a third section, a fourth section forming a substantially 180° bend and a fifth section disposed substantially parallel to the rail and adapted to exert a clamping effort on the base flange of the rail, and an anchoring device adapted to receive the spring clip and embedded or fixed in the rail support, wherein the spring clip comprises a sixth section disposed transversely with respect to the fifth section, being directed towards the first section so that, when the spring clip is mounted on the anchoring device, the spring clip clamps the base flange of the rail by its fifth section, and a transverse sixth section cooperates with an aperture for stopping displacement of the spring clip, fast with the anchoring device.

8 Claims, 6 Drawing Sheets

FIG. 1
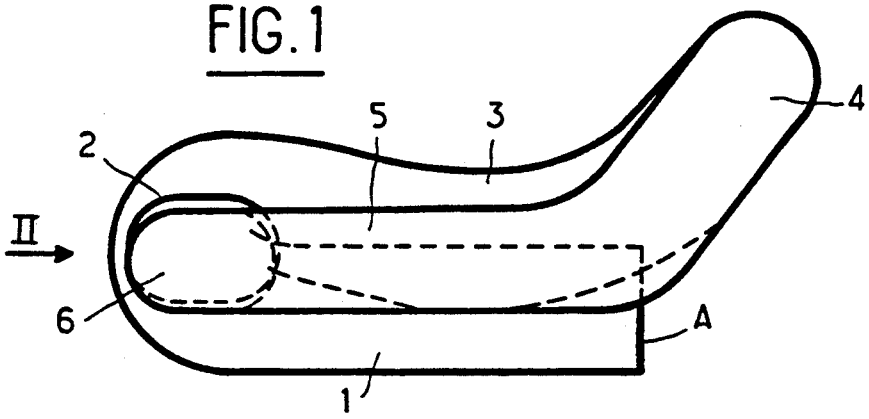
FIG. 2
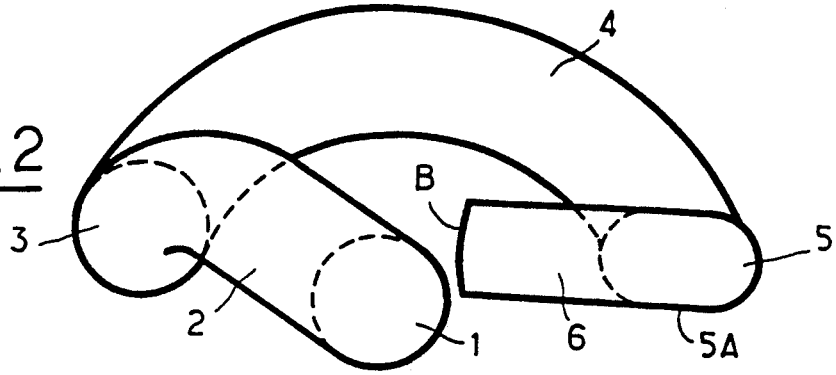
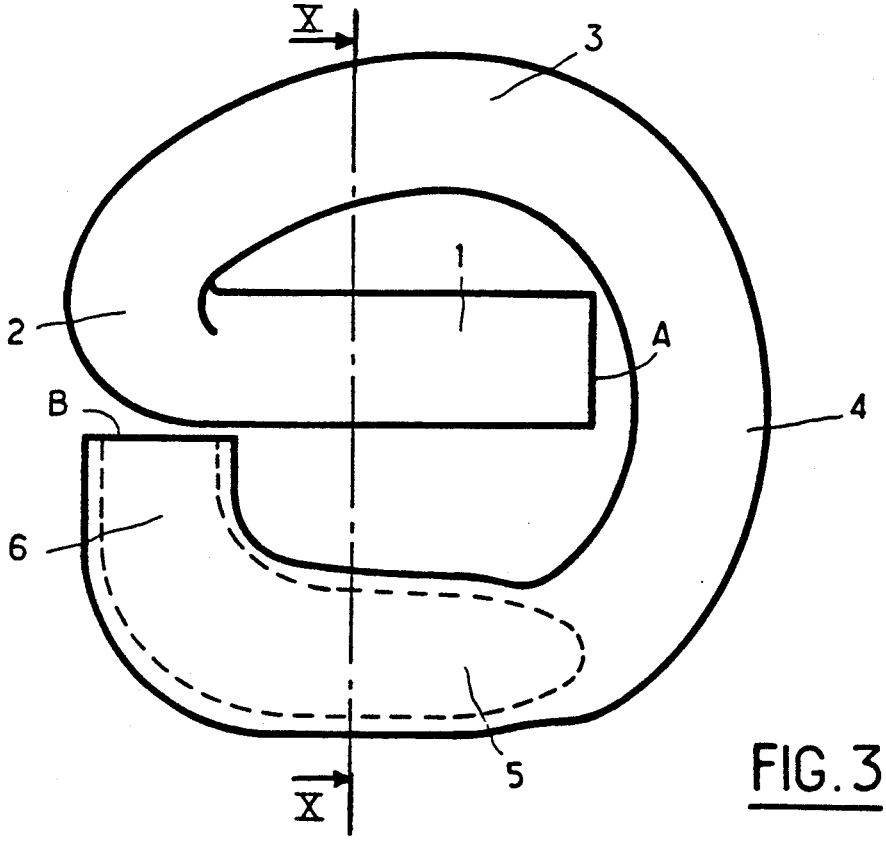
FIG. 3

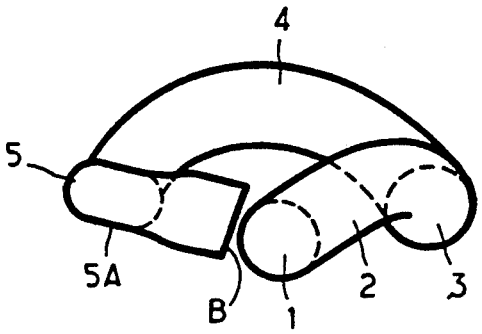
FIG.5
FIG.4
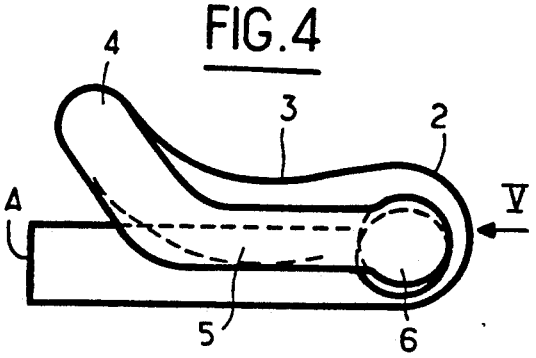
FIG.6
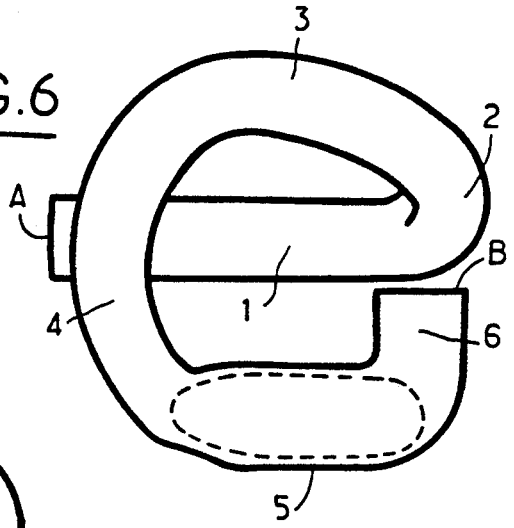
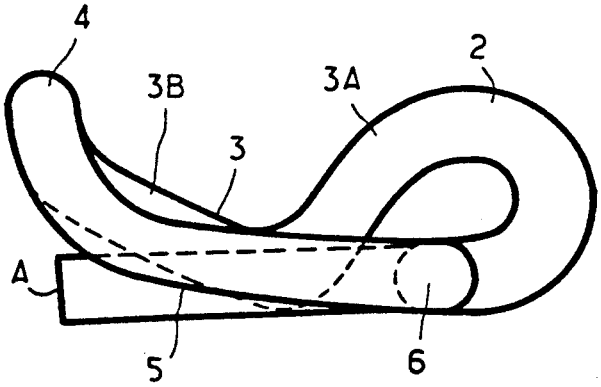
FIG.7
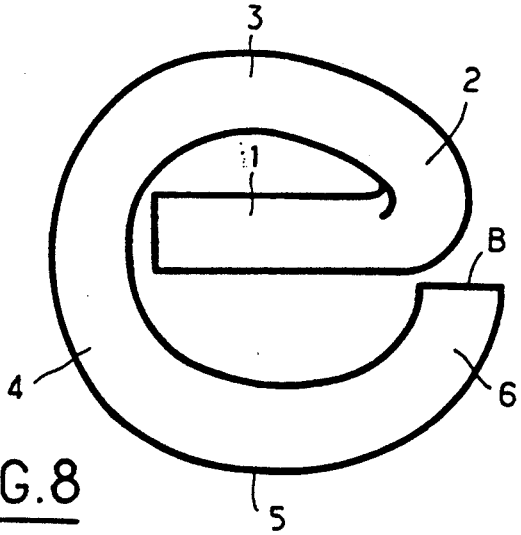
FIG.8

FIG. 9
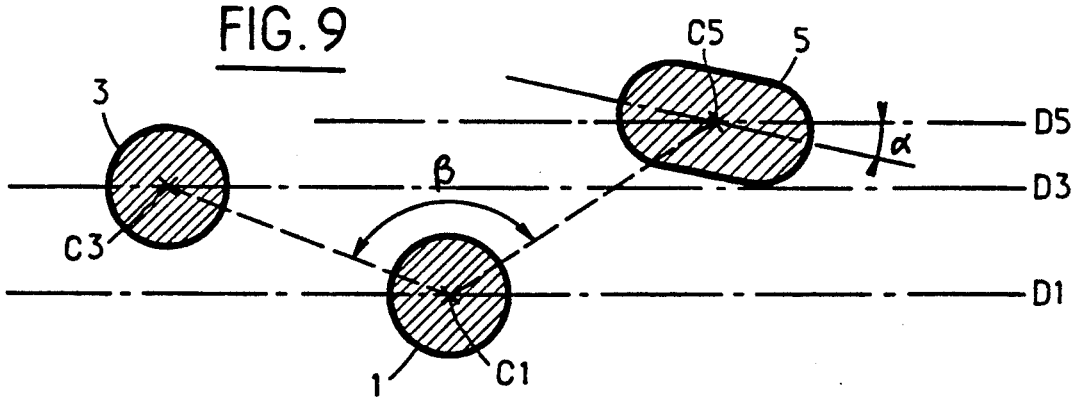
FIG. 10
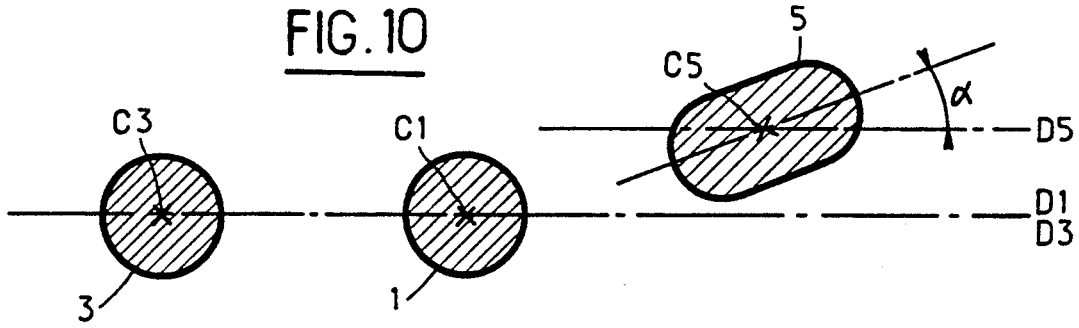
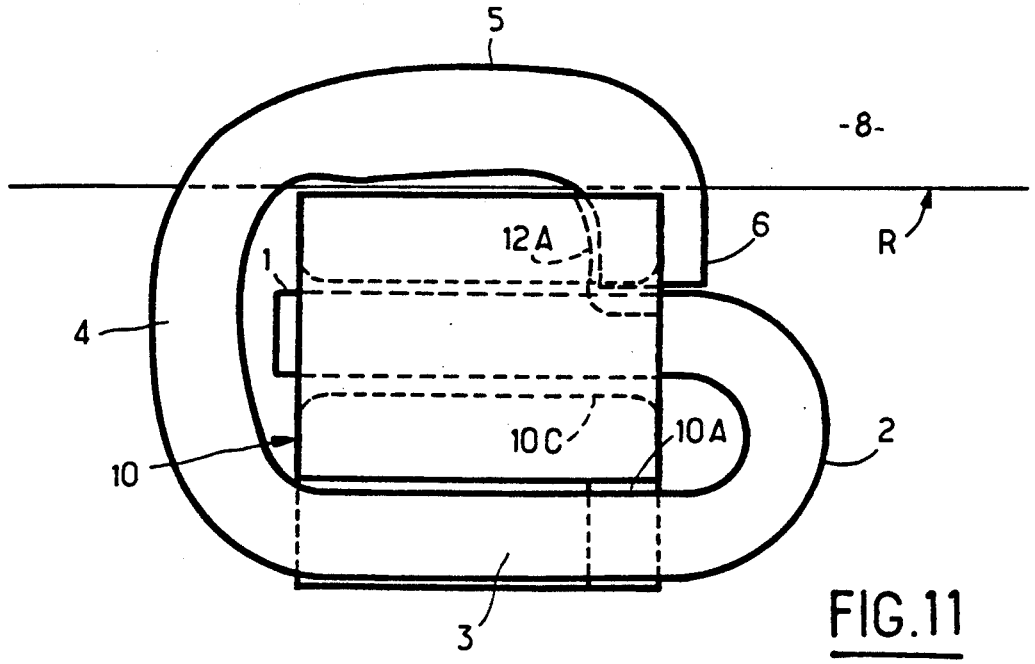
FIG. 11

CLIP FOR FASTENING A RAIL OF A RAILWAY COMPRISING DISPLACEMENT STOPPING MEANS AND SPRING CLIP

The present invention relates to a clip for fastening the rails of a railway on their sleepers, comprising displacement stopping means and spring, and in particular to an improvement in or relating to the systems described in French Patents Nos. 2 256 287 and 2 330 803.

As is known, the rails rest on sleepers or ties (made of wood, concrete or metal), on slabs, or on metal or plastic parts known as "base plates", which base plates rest on sleepers or slabs. In the following description, the word "support" will be used to designate these sleepers, base plates or slabs. Between the lower base flange of rail and the support is intercalated a so-called sole plate, generally made of rubber. Its role is to constitute an elastic shock absorber allowing the rail to move slightly with respect to its support, thus avoiding ruin of the support under the effect of the shocks and efforts generated by the rolling stock. In order to conserve the geometry of the railway, despite the various efforts induced in the rail and the slight movements thereof, means for clamping the rail on its support must obviously be provided. These clamping means generally abut on the edge of the base flange and are anchored in the supports. At the present time and taking into account the use under the rail of elastic soles, these rail clamping means are also elastic so as to conserve as much as possible their effort of clamping on the rail despite the slight movements of the latter or the possible relaxations of the anchorings of these clamping means in the supports. In the following description, the clamping means and their anchorings will be collectively referred to as rail clips.

There are several families of rail clips, in particular screwed and non-screwed clips. Among the non-screwed clips, there is a large number of different designs. One of the most recent and most wide-spread non-screwed designs is the one disclosed in French Patents Nos. 2 256 287 and 2 330 803.

However, this design presents a relatively major drawback that the present invention intends to eliminate. Beforehand, the functioning of a rail clip according to French Patents 2 256 287 and 2 330 803 should briefly be recalled. To that end, the description and numbering of Patent 2 256 287 will be employed.

Such a clip is shown in clamped position in FIG. 9 of said Patent. This clip comprises a spring (according to FIGS. 1 to 3 or 4 to 6) and an anchoring means 10 fast with the support 6. To place it in this position, section 1 of the spring must be introduced (by lateral translation with respect to the rail) into the hole 10C of the anchoring means 10. During such introduction, section 3 of the spring is obliged to rise along ramp 10A and the spring is thus deformed; this causes an effort of clamping by section 5 on the rail 8 (an insulating insert 9 simply enabling contact between the spring and the rail to be avoided).

The behaviour of the rail and firstly the stresses to which it is subjected will now be examined.

These stresses are mainly of two orders:

the action of the wheels of the rolling stock, the action of the variations in temperature.

It is the action of the wheels which must be examined in greater detail:

During their passage, the wheels exert an oblique effort on the rail head, which effort may be broken down into a vertical effort directed downwardly and perpendicular to the rail and a lateral effort directed towards the outside of the track and contained in a plane perpendicular to the rail The rail therefore tends to rotate on itself, about its own longitudinal axis. During passage of an axle, and especially in a curve, the two lines of rail of the same railway track thus rotate but in opposite directions from each other, which causes a localized widening of the gauge of the track. Such widening of the gauge may become critical in curves of small radius or when the cant given to the curved track is very different from the theoretical one which would correspond to the speed of the vehicle. This phenomenon is also accentuated by certain designs of rolling stock which present an effort of curvetaking of the vehicle greater than others. In a curve of 200 to 300 metres of radius, the lateral component of the effort exerted by the wheel on the rail head may easily attain 4 to 5 tons for an axle of 20 to 22 tons. The two clips located on either side of the same rail therefore do not have the same work to effect at all. Outside the track, the edge of the rail head firstly tends to move towards the support and, inside the track, the edge of the head tends to rise. Thus, outside the track, section 5 of the spring (according to French Patent 2 256 287) tends firstly to lower in order to follow the movement of the edge of the head and, on doing so, it exerts a weaker clamping force; whereas, inside the track, section 5 of the spring is subjected to a lift.

Now, this spring, like any spring, has a certain work range possible; the more section 5 is forced to lift, the more the spring is deformed. Beyond a certain threshold, this deformation becomes partly irreversible: the "elastic" domain then passes to the "plastic" domain. When the rail returns to its nominal position, the spring no longer returns completely into its nominal position or no longer returns with the same force as it is out of shape. Section 5 may even no longer touch the insulating insert 9, i.e. the rail is no longer clamped at all. If this phenomenon affects several consecutive supports, a derailment may result.

Another serious aspect is that this cannot be noticed by a simple visual inspection and there is no possible means of correction (unless the spring is changed), as is generally the case with screwed clips.

When a clip according to French Patent 2 256 287 or 2 330 803 has thus been forced and has lost all or part of its clamping effort, the movements of rotation of the rail, generally called "tilt", may amplify. The phenomenon of destruction of the clips also amplifies and is self-continuing. The greater these movements of rail tilt, the more there is reciprocal wear between the clips and the rail. Such wear of the clips also leads to a reduction in the clamping efforts on the rail. It may be thought that, in order to avoid this phenomenon of tilt of the rail, it would be sufficient to design a clip which clamps the rail further. However, in that case, this would necessitate considerably stiffening the clip which would lose part of its elasticity and would become fragile.

The problem therefore comes from the fact that these non-screwed clips made in accordance with French Patent 2 256 287 or 2 330 803 do not present a considerable increase in stiffness relative to the tilt of the rail; the springs used behave in quasilinear manner in their curve: effort/deformation in the vicinity of the point of functioning of the clip, i.e. in clamped position on the rail. They have the same stiffness under load as under noload. This is the major drawback with which they are reproached, which prevents the use of this type of clips with very flexible soles beneath the rail on heavy-traffic networks Now, there is always advantage in using very flexible soles beneath the rail in order to protect the supports as much as possible, and particularly when the latter are sleepers made of concrete, from the aggressions of the rolling stock (wheel/rail shocks due to irregular surface of the wheels or the rails). However, in order to use a very flexible (compressible) sole a clip system is necessary which prevents a prohibitive tilting of the rail on its foundation under the effect of the lateral efforts.

It is thus an object of the present invention to solve the new technical problem consisting in providing a clip for fastening a rail on a rail support which presents, with respect to the tilt of the rail, an absolute stoppage if the movement of tilt exceeds a certain value.

This new technical problem is solved for the first time by the present invention by a solution which is extremely simple in design, inexpensive and adapted to be used on an industrial scale.

In other words, the present invention has for its object to overcome the drawbacks of the clips made in accordance with French Patents 2 256 287 or 2 330 803 by providing clips presenting with respect to the tilt of the rail an absolute stoppage if this tilt exceeds a certain value.

Such stoppage is an appreciable improvement in the case of non-screwed clips as it is, difficult to imagine this possibility in clip systems where the anchoring pre-exists in the support in non-removable manner, contrarily to the screwed clips where, after having positioned the rail on its support and the springs of the clips, the screw head or the nut may be adjusted to ensure a stoppage preventing upward functioning of the clip, i.e. preventing the rail from lifting with respect to its support.

Consequently, the invention provides a clip for fastening a rail of a railway on a rail support comprising:

a spring clip forming a means for fastening or clamping the rail on a rail support, constituted by a clip made of elastic metal having a first end (A) and a second end (B) and presenting successively, from the first end (A), a first section forming a substantially rectilinear arm, a second section forming a substantially 180° bend, a third section, a fourth section forming a substantially 180° bend disposed on the same side as the second section with respect to the third section, and a fifth section disposed substantially parallel to the rail and adapted to exert a clamping effort on the base flange of the rail, and an anchoring device adapted to receive the spring clip and embedded or fixed in the rail support, characterized in that the spring clip comprises a sixth section disposed transversely with respect to the fifth section, being directed towards the first section so that, when the spring clip is mounted on the anchoring device, the spring clip clamps the base flange of the rail by its fifth section, and, preferably, said transverse sixth section cooperates with means for stopping displacement of the spring clip, fast with the anchoring device.

According to a particularly advantageous embodiment, the fastening clip is characterized in that the displacement stopping means comprise a notch made substantially parallel to the fifth section in mounted position or position of clamping of the spring clip.

According to another embodiment, said displacement stopping means comprise a shoulder on the anchoring device disposed substantially parallel to the fifth section and beneath which is engaged the sixth section.

According to a further embodiment of the invention, the fastening clip is characterized in that the sixth section is substantially perpendicular to the fifth section.

According to another preferred feature, the fastening clip according to the invention is characterized in that the said displacement stopping means constitute displacement stopping means acting against a lift of the fifth section further to a lifting movement of the rail.

Finally, according to yet another feature of the invention, the fastening clip in which the anchoring device comprises a longitudinal orifice in which is introduced, by translation, the first section of the spring clip, is characterized in that it comprises a lateral stop 12A, 15A for introduction of the spring clip in the anchoring device.

The principle of the invention is therefore to modify the shape of the spring shown in FIGS. 1 to 3 or 4 to 6 of French Patents Nos. 2 256 287 or 2 330 803 and the shape of the anchoring means of said spring so that, if the section 5 of said spring, when the latter is already placed in position and clamps the rail, is subjected to an upward displacement due to the lift of the base flange of the rail, said section 5 comes partly into abutment with a part of the anchoring means 10.

This stop must obviously not prevent the positioning of the rail on its support, when the track is laid. The invention consists more precisely in bending a part of the section 5 of said spring and in making a notch or a shoulder in the anchoring means 10 such that the bent part 6 of the section 5 comes as late as possible, at the end of positioning of the spring, beneath the shoulder or in the notch of the insert 10.

The invention will be more readily understood on reading the following description with reference to the accompanying drawings, in which:

FIGS. 1, 2 and 3 are respective side, end and plan views of the spring part of a rail clip according to the present invention.

FIGS. 4, 5 and 6 are the homologues of FIGS. 1, 2 and 3, except that they concern a spring clip symmetrical to the preceding one (but still according to the present invention).

FIGS. 7 and 8 are variants concerning the shape of the spring clip.

FIG. 9 is a section along XX of FIG. 3, but without showing the parts located outside the plane of section.

FIG. 10 is a variant of FIG. 9.

FIG. 11 is a plan view of a rail clip according to the present invention, i.e. comprising a modified spring clip and a modified anchoring means.

Figure 12:
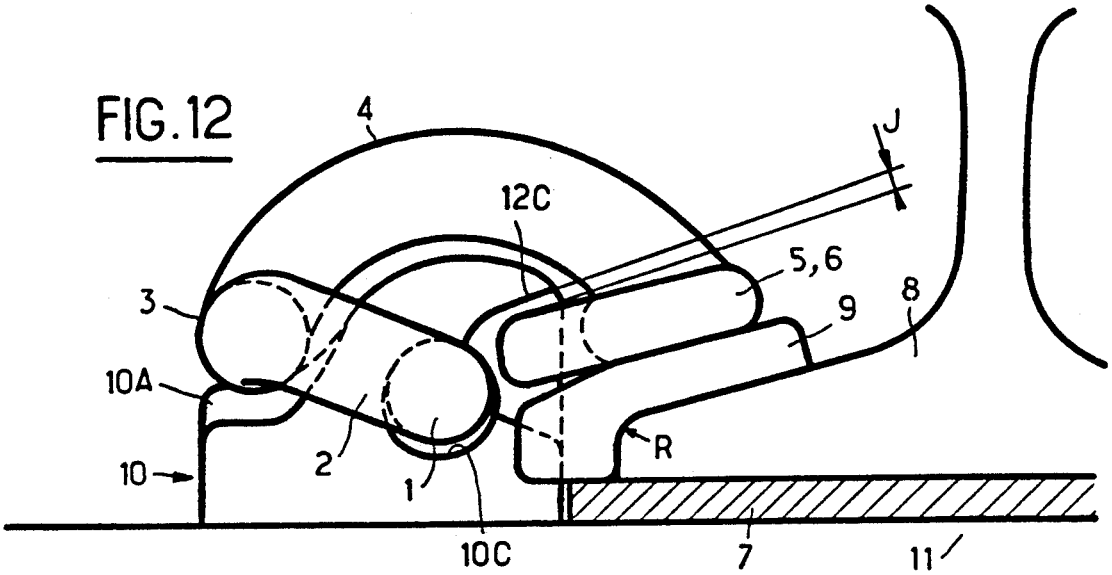
FIG. 12 is an end view of a clip according to the present invention.
Figure 13:
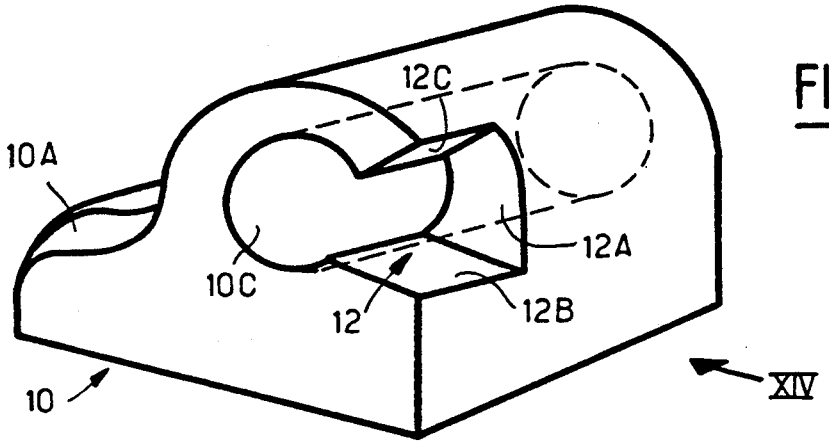

FIG. 13 is a view in perspective of the upper part of an anchoring means according to the present invention and as used in FIG. 12. The upper part of the anchoring means is understood to mean that part of the anchoring means which emerges above the support and which serves to receive the spring clip. The captive part of the support may, for its part, be of any shape.

Figure 14:
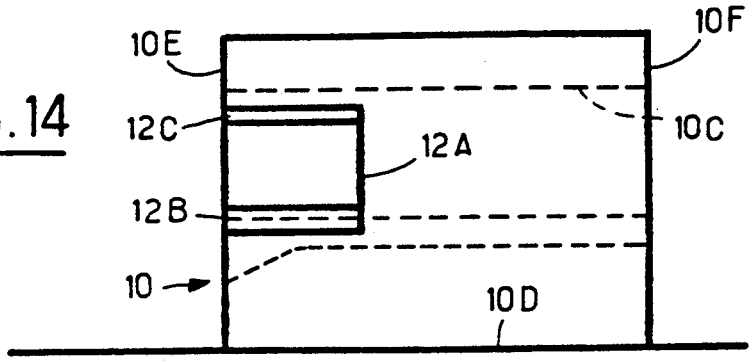

FIG. 14 is a view of FIG. 13 along XIV.

Figure 15:
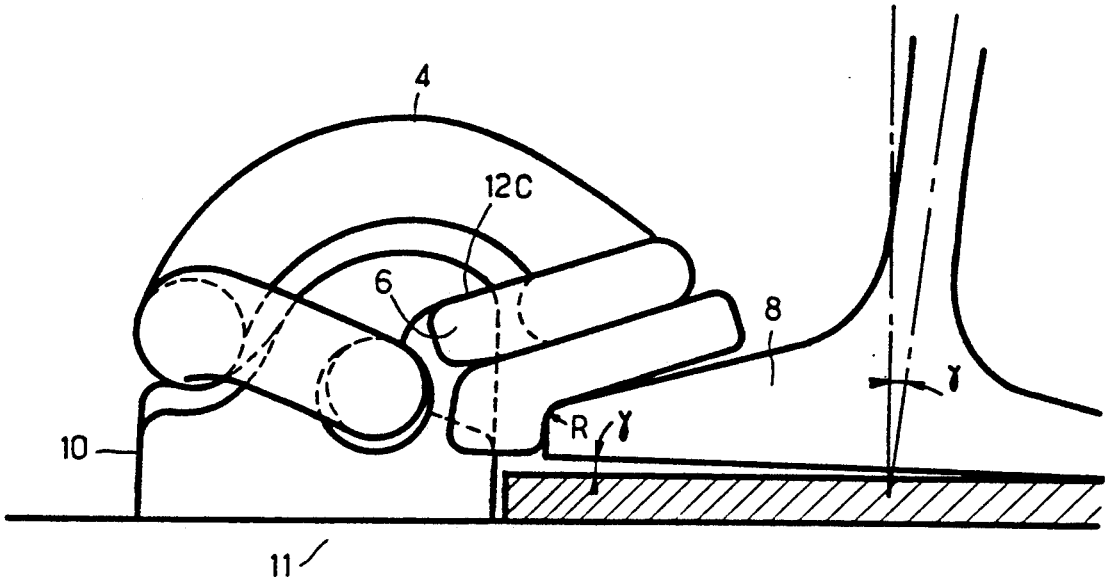

FIG. 15 is an end view identical to FIG. 12 but with the rail stopped in its movement of tilt thanks to the present invention.

Figure 16:
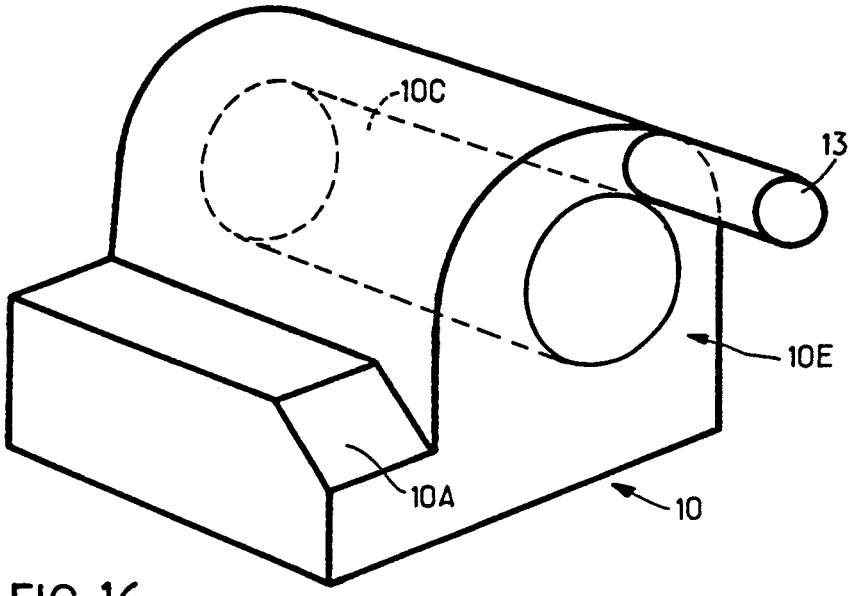

FIG. 16 is a variant embodiment of the top of the anchoring means also in accordance with the present invention.

Figure 17:
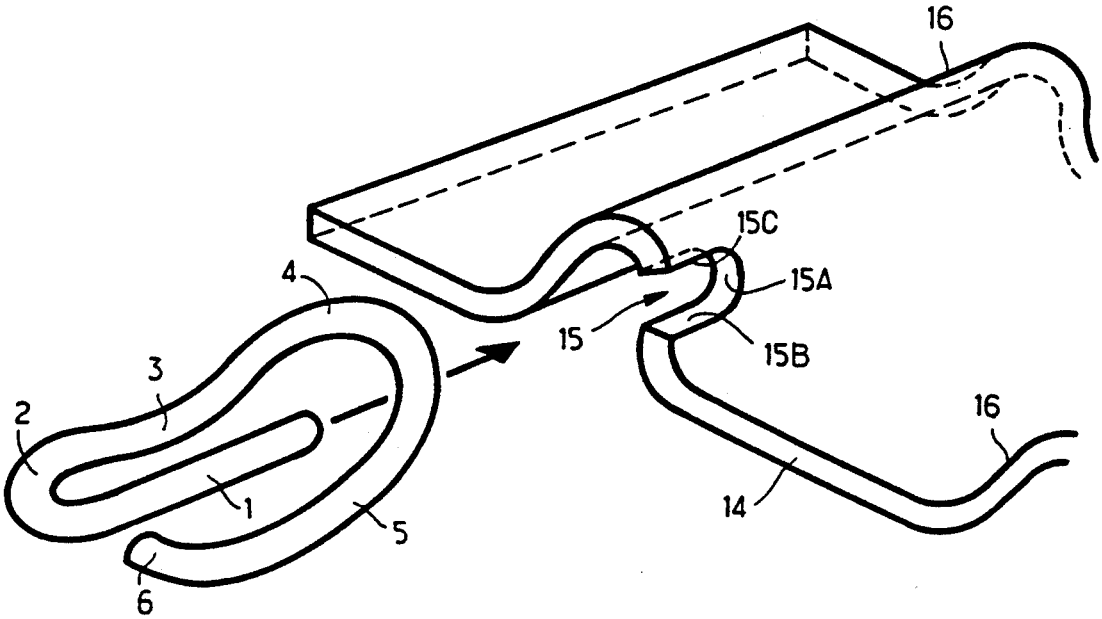

FIG. 17 is an example of application of the invention to laying on a base plate, in a view in perspective of the spring clip and of part of the base plate.

Referring now to the drawings, FIGS. 1 to show a spring clip according to the present invention which is preferably formed by a one-piece metal rod presenting several bends, with a first end A and a second end B.

Starting from the first end A, this spring clip successively comprises:

- a first section 1 forming a substantially rectilinear arm which is advantageously defined, as will be subsequently seen, substantially by a straight line which is both horizontal and substantially parallel to the rail,
- a second section 2 forming a substantially 180° bend, which may or may not be inscribed in a plane,
- third section 3 which is advantageously more or less incurved,
- a fourth section 4 forming a substantially 180° bend disposed on the same side as the second section 2 with respect to the third section 3, and
- a fifth section 5 disposed substantially parallel to the rail and adapted to exert a clamping effort on the base flange of the rail.

According to the present invention, this spring clip is characterized in that it comprises a sixth section 6 disposed transversely with respect to the fifth section 5, being directed towards the first section, so that, when the spring clip is mounted on an anchoring device, which will be described hereinafter with reference to FIGS. 11 to 17, the spring clip according to the invention clamps the base flange of the rail by its fifth section.

The transverse sixth section 6 cooperates with displacement stopping means of the spring clip, fast with the anchoring device.

These means will be described in greater detail with reference to FIGS. 11 to 17.

The bend of the fourth section 4 advantageously presents a greater radius of curvature than that of the bend of the second section 2, with the result that the fifth section 5 is disposed beyond the first section 1 with respect to the third section 3.

The second element of the fastening clip according to the invention concerns an anchoring device referenced 10 or 16 in FIGS. 11 to 17, which is adapted to receive the said spring clip and which is embedded or fixed in the rail support, as described hereinafter.

FIGS. 1 to 3 show that the sixth section 6 is advantageously disposed substantially perpendicularly to the fifth section 5.

The lower part of the fifth section 5 and, advantageously, that of the sixth section 6, may comprise a flat portion referenced 5A. Similarly, a flat portion may be provided on the upper part of the sixth section 6 which cooperates with the anchoring device.

It may, moreover, be observed that the spring clip according to the invention, shown in FIGS. 1 to 3, resembles a back-to-front "e".

FIGS. 4, 5 and 6 are respectively the homologues of FIGS. 1, 2 and 3 and concern the spring clip according to the invention, presenting a reverse shape, resembling an "e".

However, two minor variants have been made to illustrate various possible embodiments. For example, section 1 is longer than in FIGS. 1, 2 and 3 and thus comes beneath the fourth bent section.

In addition, the sixth section according to the invention does not comprise a flat portion and remains substantially round in cross section.

FIG. 7 is another variant of FIG. 4. The second bent section 2 is more developed than in the preceding embodiments, and the third section 3 presents a considerable camber 3A, 3B. Similarly, the fifth and sixth sections do not comprise a flat portion or crushed part.

FIG. 8 is a variant of FIG. 6 in which the fourth section 4, fifth section 5 and sixth section 6 may issue from the same helicoidal ramp and also present a substantially constant curvature.

FIG. 9 shows a section along XX of FIG. 3. Considering that the axis of section 1 is a horizontal, the straight line D1 shown in FIG. 9 is a horizontal straight line perpendicular to the axis of the section 1 and passing through the centre C1 of said section 1. Straight lines D3 and D5 are lines parallel to D1, passing through centres C3 and C5 of the respective cross sections of sections 3 and 5. In this Figure, D3 is shown between D1 and D5, but D5 may also be between D1 and D3 or D1 between D3 and D5. FIG. 9 defines two angles $\alpha$ and $\beta$. The angle (C3, C1, C5) called $\beta$ is reduced when the spring clip is positioned in its anchoring means.

Angle $\alpha$ is the one formed by the principal axis of the crushed cross section of section 5 and the straight line D5. This angle will evolve during positioning of the spring clip in order to follow the inclination of the base flange of the rail or the possible insulating insert. Such evolution of the angle will cause a rotation of the section 6 about an axis substantially merged with that of section 5.

FIG. 10 is simply a variant of FIG. 9 intended to show that any two of the three straight lines D1, D3 and D5 may be merged. Angle $\alpha$ may be zero, positive or negative. Angle $\beta$ may be less than, equal to or more than 180°. The same spring clip will present in its conventional version such a shape that the different possible transverse sections XX are evolutive as regards angle $\beta$.

FIG. 11 is a plan view of a fastening clip according to the invention, i.e. showing in clamped position the combination of a spring clip according to the invention and an anchoring device both presenting the necessary modifications. The spring clip is mounted in the anchoring device, i.e. section 1 is fitted by translation in a longitudinal cylindrical hole 10C in the anchoring means 10.

As described previously, the spring clip presents a sixth section 6 which, during assembly, passes in a recess 12, or notch, made in the anchoring device 10 constituting displacment stopping means. This recess also presents a wall 12A which serves, if necessary, as stop for the sixth section 6; this makes it possible always to drive the spring clips on their inserts in the same way without having to use the second section 2 in abutment on the anchoring means 10. In fact, section 2 is the seat of considerable torsional stresses and it must be prevented from being damaged or rubbing in contact with the anchoring means 10. This recess 12 is made substantially parallel to the fifth section 5 in mounted or clamping position.

The present invention thus presents the unexpected and additional advantage of better controlling the driving stroke of the spring clip in its anchoring means and of avoiding the spring breaking in the second bent section 2.

In FIG. 11, reference 8 designates the rail (seen from above) and R designates the edge of the base flange of said rail. In order not to overload this Figure unnecessarily, a non-insulating installation has been shown here, i.e. without the intermediate insulating plate which will be shown at 9 in FIG. 12.

FIG. 12 is an end view of a fastening in clamped position and in accordance with the present invention. It shows the rail 8 resting on an elastic sole 7 which rests on the support 11. Between the base flange of the rail 8 and the fifth section 5 of the spring clip there is inserted an electrically insulating plate 9. For the anchoring means 10, only the top part is shown; the captive part of the anchoring means in the support 11 has not been shown.

Between the sixth section 6 of the spring and face 12C of the recess made in the anchoring means 10 there is provided a clearance J which will be included between 0 and 10 mm, and preferably between 0 and 4 mm. When the rail tends to lift, for example during tilt under the effect of a lateral effort on the rail head, the edge R of the base flange of the rail 8 tends to move upwards parallel to itself, which brings about an upward displacement of the sections 5 and 6 of the spring clip. However, section 6 quickly comes into abutment on the upper face 12C of the notch made in the anchoring means, constituting displacement stopping means acting against a lift of the fifth section 5 further to a lifting movement of the rail, this sharply stopping the movement of the rail. This FIG. 12 shows an approximate parallelism between the face 12C of the notch made in the anchoring means 10 and the end 6 of the spring clip. This is an ideal case, when the end 6 of the spring clip is subjected to an upward displacement under the effect of a beginning of lift of edge R of the base flange of the rail 8, for said end 6 to come into contact on a part of face 12C. In fact, face 12C and end 6 are not forcibly parallel, if only due to the various tolerances. The sixth section 6 of the spring clip will therefore firstly touch the face 12C by an edge; however, this is not a hindrance for the invention. Its purpose remains to provoke a stoppage of the movement of the rail; it is obvious that, if this effort tending to lift the rail or to cause it to tilt were to attain several tens of tons, the stoppage of the rail movement would not be complete as, either the section 6 would be twisted or sheared, or the anchoring means would be broken.

However, we remain in the conventional domain of a railway; even with axles of 20 to 35 tons, the efforts of lift of the rail or of tilt of the rail never exceed 10 to 15 tons.

A variant in the functioning of the present invention consists in dimensioning the fifth and sixth sections 5, 6 in length and thickness so that, when the sixth section 6 comes into contact with face 12C, a slight twist of the fifth section 5 is allowed. Such relative elasticity makes it possible to obtain an intermediate stage of stiffness between the stiffness of the spring clip when the sixth section 6 passes the clearance J and the total stoppage with quasi-infinite stiffness of the system, when section 6 is wedged between face 12C and the insulating insert 9 (or the rail 8 laid directly without insert).

FIG. 13 shows a possible embodiment of the notch 12 in the upper part of the anchoring means 10. This notch is limited by faces 12A, 12B and 12C.

Face 12C serves to stop the upward displacement of section 6 of the spring clip, as has been seen hereinabove.

Face 12A may usefully serve as end-of-stroke stop during introduction of the spring clip in its anchoring means; the sixth section 6 coming at the end of positioning of the spring clip against face 12A. This avoids the interior of the bend 2 of the spring accidentally being in abutment on the flank of the anchoring means 10 (upon laying or subsequently).

Face 12B must be such that it does not hinder downward functioning of sections 5 and 6 of the spring clip, i.e. in no wise must section 6 be able to touch it. To that end and in practice, all points of this face 12B must lie beneath a horizontal plane passing through the edge R of the base flange of the rail 8, and preferably at more than 2 mm from said horizontal plane.

FIG. 14 is a view along XIV of FIG. 13, and shows face 12A perfectly orthogonal with respect to the axis of the bore 10C made in the anchoring means 10. Such perpendicularity is, however, not absolutely indispensable; face 12A may also be curved in order to match the radius of connection between sections 5 and 6 of the spring clip.

Face 12A, whilst remaining substantially perpendicular to the bearing face 10D of the anchoring means 10, may also be slightly inclined with respect to the axis of bore 10C. This slight inclination may attain about $\pm 15$ degrees. In that case, a spring clip will be used, of which the angle between the axis of section 5 and the axis of section 6 will be adapted to this inclination of the face 12A, so as always to guarantee the possibility of a good contact between the side of section 6 and the face 12A.

FIG. 15 shows the assembly of FIG. 12 in blocked position; the tilt of the rail is translated by an angle $\gamma$. The lift of the edge R of the base flange of the rail 8 is translated by the placing of section 6 in contact with face 12C of the anchoring 10.

The movement of tilt of the rail 8 is thus stopped or necessitates a considerable effort since the anchoring means 10 is rigid and is perfectly embedded in the support 11.

FIG. 16 is a variant embodiment of the top of the anchoring device 10, intended to cooperate with a spring clip as described previously. The shoulder 13 performs the same role as face 12C of FIGS. 12 to 15. The lateral flank 10E of the anchoring means 10 is itself adapted to perform the same role as the face 12A of FIGS. 11, 13 and 14, i.e. serve as stop during introduction of the spring in its anchoring means. Section 6 of the spring clip is adapted to come into abutment beneath shoulder 13 and against the latter if the rail lifts or tilts with respect to its support. The shape of shoulder 13 is very schematic here and the man skilled in the art may modify it, in particular in order to reinforce it, without departing from the scope of the present invention.

FIG. 17 concerns more particularly the so-called "indirect" laying with base plate on a wooden or metal sleeper, in accordance with the present invention. The use of a base plate 14 is in fact current when the support is a metal sleeper and even necessary when the support is a wooden sleeper (from the moment when it is desired to use a spring clip as described in French Patents 2 256 287 or 2 330 803, although these Patents describe only the laying on a concrete support). In the present case, and in order to benefit from the present invention, a notch 15, limited by faces 15A, 15B and 15C has been made in the base plate 14. This base plate 14 is also provided with two bends 16 between which will be housed the rail and its sole. Bend 16 and notch 15 respectively perform the role of the anchoring 10 and of the notch 12 described in the preceding Figures.

The spring clip is placed in position by introduction of section 1 into the longitudinal recess made by bend 16.

When positioning is finished, i.e. when the fifth section 5 of the spring clip bears on the edge of the base flange of the rail or the possible insulating insert, section 6 will be housed in notch 15, in abutment against face 15A. Functioning of the system is strictly identical to what has been described hereinbefore.

With these layings on base plate, a shoulder be used, rather than a notch 15, which is identical to what has been shown in FIG. 16.

Finally, it should be noted that, in order not to render the description complicated, FIGS. 11 to 16 all assume that the same type of spring clip is used, i.e. the one described in FIGS. 1 to 3. However, it suffices that the notches or stops 12 or 13 as well as ramp 10A be made on the other side of the anchoring means 10 (i.e. side 10F instead of 10E in FIG. 14), for the anchoring means according to the invention to be able to cooperate with a spring clip according to FIGS. 4 to 8. The same comment applies to FIG. 17.

The invention also covers by way of novel industrial product the spring clip as described hereinabove and as shown in FIGS. 1 to 17 which form an integral part of the invention.

What is claimed is:

1. A clip for fastening a rail of a railway on a rail support, comprising:

a spring clip forming a means for fastening or clamping the rail on a rail support, constituted by a clip made of elastic metal in the form of an "e" having a first end (A) and a second end (B) and presenting successively, from the first end (A), a first section (1) forming a substantially rectilinear arm parallel to the rail, a second section (2) forming a substantially 180° bend, a third section (3), a fourth section (4) forming a substantially 180° bend disposed on the same side as the second section (2) with respect to the third section (3), and a fifth section (5) disposed substantially parallel to the rail and adapted to exert a clamping effort on the base flange of the rail, and an anchoring device (10 or 16) comprising a longitudinal orifice (10c) in which is introduced by translation the first section (1) of the spring clip, and an upper surface on which the third section of the spring clip rests when fitted in a clamping position, said anchoring device being also embedded or fixed in the rail support, characterized in that the spring clip further comprises a sixth section (6) disposed transversely with respect to the fifth section (5), being directed towards the first section (1), and the anchoring device further comprises displacement stopping means (12, 13 or 15) for the introduction of the sixth section (6) therein, so that, when the spring clip is mounted on the anchoring device, the spring clip clamps the base flange of the rail by the fifth section (5), and cooperates with the displacement stopping means (12, 13 or 15) for stopping vertical displacement of the fifth section (5), resulting from a rail lifting movement.

2. Fastening clip according to claim 1, characterized in that the displacement stopping means (12, 13 or 15) comprises a notch (12 or 15) made substantially parallel to the fifth section (5) when the clip is in a mounted position or position of clamping.

3. Fastening clip according to claim 1, characterized in that said displacement stopping means (12, 13 or 15) comprises a shoulder (13) on the anchoring device disposed parallel to the fifth section (5) and beneath which is engaged the sixth section (6).

4. Fastening clip according to any one of claims 1 to 3, characterized in that said displacement stopping means (12, 15) further comprises a stop means (12A, 15A) limiting the longitudinal introduction of the spring clip into the anchoring device (10, 6).

5. Fastening clip according to any one of claims 1 to 3, characterized in that the sixth section (6) is substantially perpendicular to the fifth section (5).

6. Fastening clip according to any one of claims 1 to 3, characterized in that the fourth, fifth and sixth sections are issued from the same helicoidal ramp and have a substantially constant curvature.

7. Fastening clip according to any one of claims 1 to 3, characterized in that in a mounted position of the spring clip on the anchoring device, the sixth section (6) is mounted with a vertical clearance (5) between itself and the anchoring device, thus allowing the sixth section to traverse said clearance (J) before abutting against the anchoring device.

8. Fastening clip according to any one of claims 1 to 3, characterized in that the fifth and sixth sections (5, 6) are dimensioned in length and in thickness to allow a slight twist of the fifth section (5) when the sixth section (6) comes into contact against the said displacement stopping means (12, 13 or 15).

* * * * *